US007520820B2

(12) United States Patent
Dimarco

(10) Patent No.: US 7,520,820 B2
(45) **Date of Patent: *Apr. 21, 2009**

(54) C-SHAPED GOLF CLUB HEAD

(75) Inventor: Thomas J. Dimarco, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/954,422

(22) Filed: Dec. 12, 2007

(65) Prior Publication Data

US 2008/0139336 A1 Jun. 12, 2008

Related U.S. Application Data

(60) Provisional application No. 60/869,697, filed on Dec. 12, 2006.

(51) Int. Cl.
*A63B 53/04* (2006.01)
*A63B 53/06* (2006.01)
*A63B 53/08* (2006.01)

(52) U.S. Cl. ..... 473/334; 473/335; 473/345; 473/349; 473/350

(58) Field of Classification Search ..... 473/324–350, 473/287–292, 256; D21/733, 759, 734, 735
See application file for complete search history.

(56) References Cited

U.S. PATENT DOCUMENTS 1,139,985 A * 5/1915 Legh ..... 473/350
1,452,845 A * 4/1923 Pryde ..... 473/343
1,455,379 A * 5/1923 Allen ..... 473/337
3,881,733 A * 5/1975 Csernits ..... 473/330
3,966,210 A * 6/1976 Rozmus ..... 473/341
D240,948 S * 8/1976 Redoutey ..... D21/747
3,976,299 A * 8/1976 Lawrence et al. ..... 473/327
3,995,857 A 12/1976 Cochran et al.
4,121,833 A * 10/1978 Prueter ..... 473/330
4,290,606 A * 9/1981 Maxwell ..... 473/569
4,650,191 A * 3/1987 Mills ..... 473/341
4,653,756 A * 3/1987 Sato ..... 473/327
4,828,265 A * 5/1989 Antonious ..... 473/327
4,846,477 A * 7/1989 Phelan ..... 473/330
4,869,507 A * 9/1989 Sahm ..... 473/337
5,116,047 A * 5/1992 Phelan et al. ..... 473/307
5,186,465 A * 2/1993 Chorne ..... 473/350
5,282,625 A 2/1994 Schmidt et al.
5,335,914 A * 8/1994 Long ..... 473/350
5,388,827 A * 2/1995 Reynolds, Jr. ..... 473/306
5,409,219 A * 4/1995 Saksun, Sr. ..... 473/305
5,447,309 A 9/1995 Vincent
5,456,464 A * 10/1995 Davenport et al. ..... 473/251
5,501,453 A * 3/1996 Hurst ..... 473/242
5,580,058 A * 12/1996 Coughlin ..... 273/250
5,769,736 A * 6/1998 Sato ..... 473/335
5,776,010 A 7/1998 Helmstetter et al.

(Continued)

*Primary Examiner*—Sebastiano Passaniti
(74) *Attorney, Agent, or Firm*—Michael A. Catania; Elaine H. Lo

(57) ABSTRACT

A C-shaped golf club head is disclosed herein. The body has a striking plate wall, a crown section, a sole section and a rear wall. The golf club head also has a plurality of weight members positioned on the rear wall of the body. Each of the plurality of weight members is movable along the rear wall.

14 Claims, 3 Drawing Sheets

U.S. PATENT DOCUMENTS

| | | | | |
|---|---|---|---|---|
| 5,785,605 | A | 7/1998 | Helmstetter | |
| 6,210,290 | B1 | 4/2001 | Erickson et al. | |
| 6,364,788 | B1 | 4/2002 | Helmstetter et al. | |
| 6,379,264 | B1 * | 4/2002 | Forzano | 473/336 |
| 6,394,910 | B1 * | 5/2002 | McCarthy | 473/251 |
| 6,409,612 | B1 | 6/2002 | Evans et al. | |
| 6,739,983 | B2 | 5/2004 | Helmstetter et al. | |
| 6,890,267 | B2 * | 5/2005 | Mahaffey et al. | 473/256 |
| 6,964,617 | B2 * | 11/2005 | Williams | 473/245 |
| 7,108,611 | B2 * | 9/2006 | MacIlraith | 473/288 |
| 7,147,573 | B2 * | 12/2006 | DiMarco | 473/324 |
| 2006/0122004 | A1 * | 6/2006 | Chen et al. | 473/335 |

* cited by examiner

C-SHAPED GOLF CLUB HEAD

CROSS REFERENCES TO RELATED APPLICATIONS

The Present Application claims priority to U.S. Provisional Patent Application No. 60/869,697, filed on Dec. 12, 2006.

STATEMENT REGARDING FEDERALLY SPONSORED RESEARCH OR DEVELOPMENT

Not Applicable

BACKGROUND OF THE INVENTION

1. Field of the Invention

The present invention relates to a golf club heads. More specifically, the present invention relates to a golf club head having a C-Shape.

2. Description of the Related Art

Numerous techniques have been used for weighting golf club heads in order to gain better performance. In persimmon wood club heads, weights were attached to the sole in order to lower the center of gravity. The first metal woods had sufficient weight, however, the weight distribution deterred slightly from performance. The refinement of hollow metal woods with weighting on the sole improved upon the performance of these clubs. An example of such woods were the GREAT BIG BERTHA® HAWK EYE® drivers and fairway woods, developed by the Callaway Golf Company of Carlsbad, Calif., that used a tungsten screw in the sole of each titanium club head body to vary the weight of the golf club head.

Another example is set forth in Helmstetter et al., U.S. Pat. No. 6,364,788 for a Weighting System For A Golf Club Head, which discloses using a bismuth material within an internal cavity to add mass to a golf club head, particularly a fairway wood.

Yet a further example is set forth in Evans et al., U.S. Pat. No. 6,409,612 for a Weighting Member For A Golf Club Head, which discloses a weighting device composed of a polymer body with ports to allow for placement of high density members such as tungsten spheres.

Another example of additional weighting of a golf club head is set forth in U.S. Pat. No. 5,447,309, which discloses the use of three weights fixedly disposed within the interior of a club head to provide a selected moment of inertia for the club head. Yet another example is set forth in British Patent Application Number 2332149 for a Golf Club Head With Back Weighting Member, which discloses a weight pocket in the exterior rear of a wood for placement of epoxy inserts that vary in density.

In irons, weighting of the club head has assumed many variations. One example is perimeter weighting in which the mass is shifted to the perimeter of the club head such as the BIG BERTHA® X-12® irons developed by the Callaway Golf Company and as set forth in U.S. Pat. No. 5,282,625. An example of additional weighting is set forth in U.S. Pat. No. 3,995,857 which discloses the placement of tungsten inserts into the rear of an iron.

Another example of additional weighting is the GREAT BIG BERTHA® TUNGSTEN-TITANIUM™ irons, developed by the Callaway Golf Company, which used a screw to attach a tungsten block to the rear and sole of a stainless steel iron as set forth in U.S. Pat. No. 5,776,010.

Yet another example is the GREAT BIG BERTHA® TUNGSTEN-INJECTED™ HAWK EYE® irons, also developed by the Callaway Golf Company, which feature an internal cavity with tungsten pellets in a solder, as set forth in U.S. Pat. No. 6,210,290, for a Golf Club And Weighting System. The weighting of putters has varied as with woods and irons.

An example of positioning mass in a golf club head for performance is disclosed in Helmstetter et al., U.S. Pat. No. 6,739,983 for a Golf Club Head With Customizable Center Of Gravity, which discloses a method and golf club head which allows a golfer to select a preferred center of gravity location for better ball striking.

A further example of positioning mass for performance is set forth in Helmstetter, U.S. Pat. No. 5,785,605 for a Hollow, Metallic Golf Club Head With Configured Medial Ridge, which discloses a golf club head with a center of gravity located in vertical alignment with a local zone defined by ridge on a sole of the golf club head.

However, prior technology have been similar in that the weighting means, whether it is a medallion, plug, insert or the like, is a static weight and mass. More precisely, once positioned on the club head, the weight does not change. If a new weight is desired, then the old weight is removed and an entirely new weight means is placed on the golf club head. The weights may be ground to remove mass in order to lower the weight, however, these prior art weights cannot easily have their mass increased by the addition of material.

Further, each of the prior art weighting means have a fixed and unchangeable center of gravity ("CG") and fixed and unchangeable moments of inertia ("MOI"). The CG cannot be moved and the MOI cannot be increased or decreased without dimensionally changing the prior art weighting means. Thus, the golf industry needs a weighting mechanism that allows for greater flexibility to adjust, the CG, MOI and also the swingweight on a golf club.

BRIEF SUMMARY OF THE INVENTION

The present invention is a C-shaped golf club head having adjustable weights for fitting a golf club to a golfer.

One aspect of the present invention is a golf club head with a body having a generally C shape. The body has a striking plate wall, a crown section, a sole section and a rear wall. The golf club head also has a plurality of weight members positioned on the rear wall of the body. Each of the plurality of weight members is movable along the rear wall.

Preferably, the body has a volume ranging from 420 cubic centimeters to 470 cubic centimeters. More preferably, the body has a volume ranging from 455 cubic centimeters to 465 cubic centimeters.

Preferably, the body is composed of a material selected from the group consisting of titanium, titanium alloy, steel, magnesium, magnesium alloy, aluminum, aluminum alloy, pre-preg material, thermoplastic polyurethane, and polycarbonate.

Preferably, each of the plurality of weight members ranges in mass from 5 grams to 60 grams. More preferably, each of the plurality of weight members ranges in mass from 10 grams to 40 grams. Even more preferably, each of the plurality of weight members ranges in mass from 15 grams to 30 grams.

Preferably, the golf club head has mass ranging from 150 grams to 350 grams. More preferably, the golf club head has mass ranging from 180 grams to 250 grams. Even more preferably, the golf club head has mass ranging from 190 grams to 220 grams.

Preferably, the golf club head has a moment of inertia Izz about the center of gravity ranging from 3000 g-cm$^2$ to 6000 g-cm$^2$. More preferably, the golf club head has a moment of inertia Izz about the center of gravity ranging from 4000 g-cm$^2$ to 5000 g-cm$^2$.

Preferably, the golf club head has a moment of inertia Iyy about the center of gravity ranging from 2000 g-cm$^2$ to 4000 g-cm$^2$. More preferably, the golf club head has a moment of inertia Iyy about the center of gravity ranging from 2500 g-cm$^2$ to 3500 g-cm$^2$.

Preferably, the golf club head has a moment of inertia Ixx about the center of gravity ranging from 2000 g-cm$^2$ to 4000 g-cm$^2$. More preferably, the golf club head has a moment of inertia Ixx about the center of gravity ranging from 2500 g-cm$^2$ to 3000 g-cm$^2$.

Preferably, the striking plate wall has variable face thickness.

Preferably, the plurality of weight members is composed of four weight members, with two of the weight members each movable along a crown and sole axis, and two of the members each movable along a heel to toe axis.

Another aspect of the present invention is a golf club head with a plurality of movable weights. The golf club head also includes a body having a front elongated section, a heel end arm and a toe end arm. The front elongated section has a striking plate wall and a rear wall. The heel end arm has a rear wall, an external side wall and an internal side wall. The toe end arm has a rear wall, an external side wall and an internal side wall. Each of the plurality of first weight members is positioned on the rear wall of the front elongated section. Each of the plurality of first weight members is movable along the rear wall. At least one second weight member is positioned on the rear wall of the heel end arm and movable along a crown to sole axis. At least one third weight member is positioned on the rear wall of the toe end arm and movable along a crown to sole axis.

The body preferably has a volume ranging from 250 cubic centimeters to 500 cubic centimeters. More preferably, the body has a volume ranging from 420 cubic centimeters to 470 cubic centimeters. Even more preferably, the body has a volume ranging from 455 cubic centimeters to 465 cubic centimeters.

Preferably, the body of this embodiment is composed of a material selected from the group consisting of titanium, titanium alloy, steel, magnesium, magnesium alloy, aluminum, aluminum alloy, pre-preg material, thermoplastic polyurethane, and polycarbonate.

Preferably, each of the first weight members, the second weight member and the third weight member ranges in mass from 5 grams to 60 grams. More preferably, each of the first weight members, the second weight member and the third weight member ranges in mass from 10 grams to 40 grams. Even more preferably, each of the first weight members, the second weight member and the third weight member ranges in mass from 15 grams to 30 grams.

Preferably, the golf club head of this embodiment has mass ranging from 150 grams to 350 grams. More preferably, the golf club head of this embodiment has mass ranging from 180 grams to 250 grams. Even more preferably, the golf club head of this embodiment has mass ranging from 190 grams to 220 grams.

Preferably, the golf club head of this embodiment has a moment of inertia Izz about the center of gravity ranging from 3000 g-cm$^2$ to 6000 g-cm$^2$. More preferably, the golf club head of this embodiment has a moment of inertia Izz about the center of gravity ranging from 4000 g-cm$^2$ to 5000 g-cm$^2$.

Preferably, the golf club head of this embodiment has a moment of inertia Iyy about the center of gravity ranging from 2000 g-cm$^2$ to 4000 g-cm$^2$. More preferably, the golf club head of this embodiment has a moment of inertia Iyy about the center of gravity ranging from 2500 g-cm$^2$ to 3500 g-cm$^2$.

Preferably, the golf club head of this embodiment has a moment of inertia Ixx about the center of gravity ranging from 2000 g-cm$^2$ to 4000 g-cm$^2$. More preferably, the golf club head of this embodiment has a moment of inertia Ixx about the center of gravity ranging from 2500 g-cm$^2$ to 3000 g-cm$^2$.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
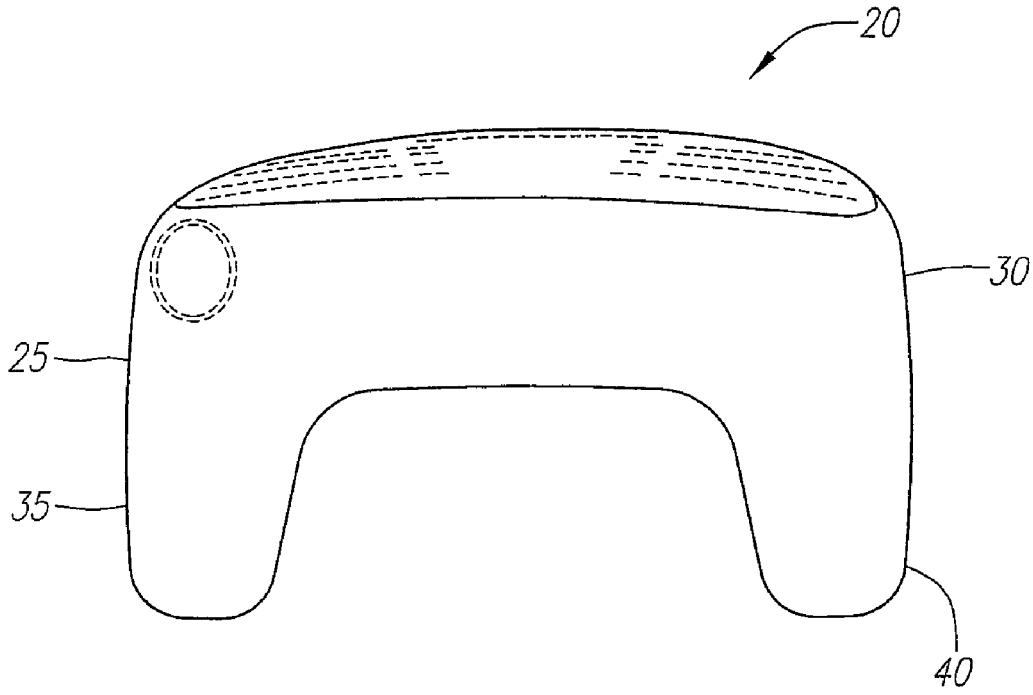
FIG. 1 is a top plan view of a golf club head.
Figure 2:
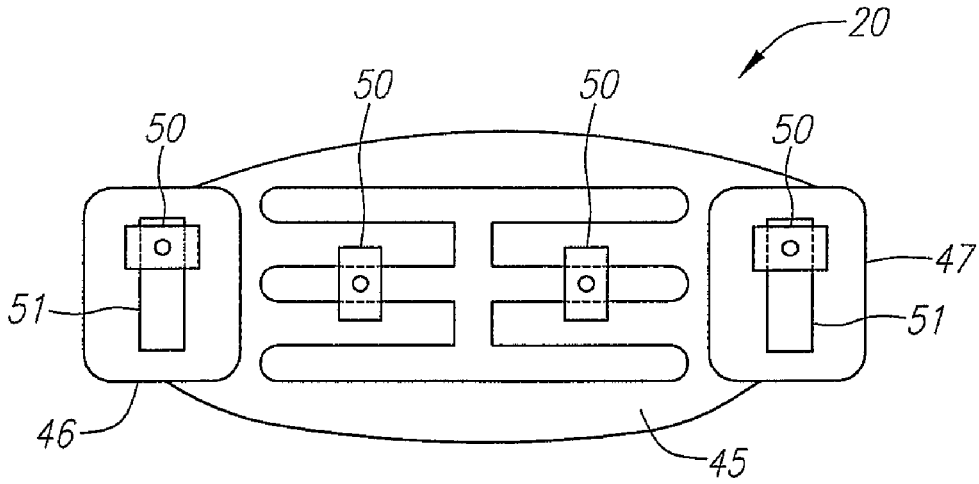
FIG. 2 is a rear view of a golf club head.
Figure 3:
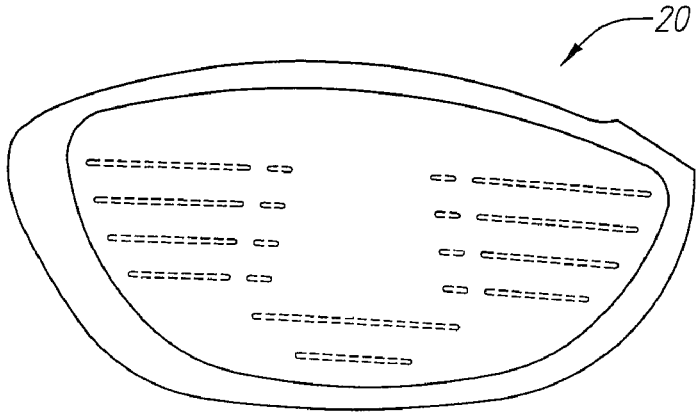
FIG. 3 is a front plan view of a golf club head.
Figure 4:
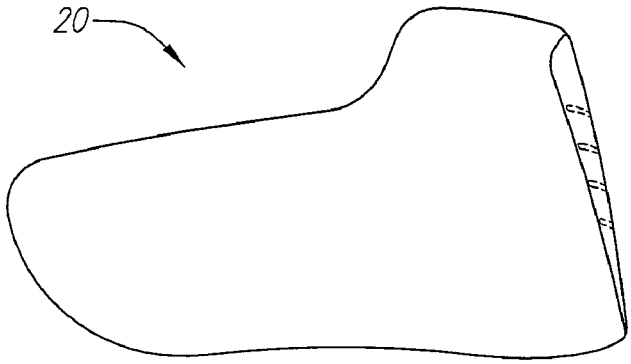
FIG. 4 is a toe side view of a golf club head.
Figure 5:
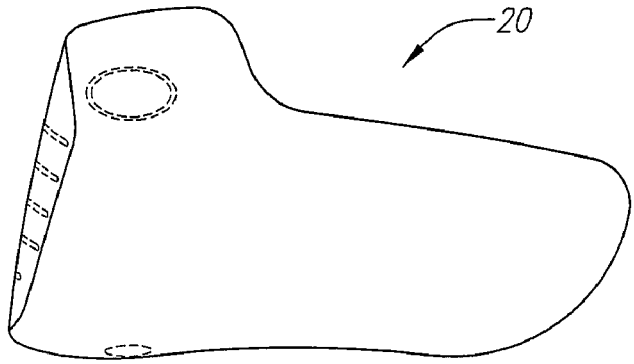
FIG. 5 is a heel side view of a golf club head.
Figure 6:
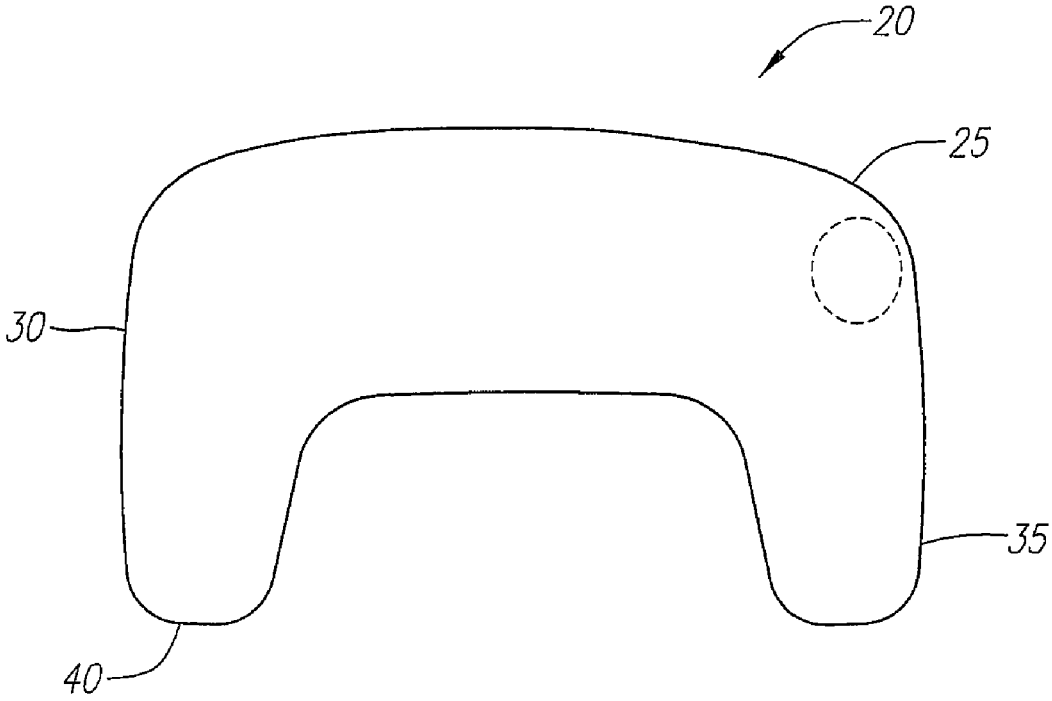
FIG. 6 is a bottom plan view of a golf club head.

A golf club 20 is illustrated in the figures. The golf club head 20 may be a driver or a fairway wood. The body 25 has a generally C-shape. More specifically, the body 25 preferably has a front elongated section 30, a heel end arm 35 and a toe end arm 40. The front elongated section has a rear wall 45, the heel end arm has a rear wall 46, and the toe end arm has a rear wall 47. A plurality of weight members 50 are positioned on the rear walls. The weight members 50 are movable along tracks 51 as shown in order to adjust the center of gravity of the golf club head 20 and the moment of inertia.

The golf club head 20 has a body 25 that is preferably composed of a metal material such as titanium, titanium alloy, stainless steel, or the like, and is most preferably composed of a cast stainless steel material. The body 25 is preferably cast from molten metal in a method such as the well-known lost-wax casting method. The metal for casting is preferably is composed of 17-4 steel alloy. Alternatively the body 25 is composed of a titanium or a titanium alloy such as 6-4 titanium alloy, alpha-beta titanium alloy or beta titanium alloy for forging, and 6-4 titanium for casting. Additional methods for manufacturing the body 25 include forming the body 25 from a flat sheet of metal, super-plastic forming the body 25 from a flat sheet of metal, machining the body 25 from a solid block of metal, electrochemical milling the body from a forged pre-form, and like manufacturing methods.

The golf club head 20 preferably has a volume from 100 cubic centimeters to 600 cubic centimeters, more preferably from 130 cubic centimeters to 475 cubic centimeters. When designed as a fairway wood, the golf club head 20 preferably has a volume ranging from 130 cubic centimeters to 300 cubic centimeters, and more preferably from 150 cubic centimeters to 275 cubic centimeters. The volume of the golf club head 20 will also vary between fairway woods (preferably ranging from 3-woods to eleven woods). When designed as a driver, the golf club head 20 preferably has a volume ranging from 300 cubic centimeters to 500 cubic centimeters, and more preferably from 350 cubic centimeters to 475 cubic centimeters.

The golf club head 20 preferably has a mass ranging from 90 grams to 250 grams, more preferably from 150 grams to 225 grams, and most preferably from 180 grams to 221 grams. The mass of the golf club head 20 will also vary between fairway woods (preferably ranging from 3-woods to eleven woods) and a driver.

The weight member 50 is preferably composed of a high density material having a density greater than the density of a typical club head material, such as steel (density of 7.87 g/cc), or titanium (density of 4.51 g/cc). Preferably, the weight member 50 is composed of tungsten (density of 19.25 g/cc), copper (density of 8.93 g/cc), gold (density of 19.28 g/cc), silver (density of 10.50 g/cc), palladium (density of 12.00 g/cc), platinum (density of 21.47 g/cc) or another similar material. A preferred material for the weight member 50 is tungsten or tungsten alloy. An alternative material is a nickel-tungsten-chromium alloy such as disclosed in U.S. Pat. No. 7,004,853, for a High Density Alloy For Improved Mass Properties In An Article, assigned to Callaway Golf Company of Carlsbad, Calif., and hereby incorporated by reference in its entirety. The weight member 50 preferably has a thickness ranging from 0.2 centimeter to 2.0 centimeters, a height ranging from 0.5 centimeter to 4.0 centimeters and a length ranging from 1.0 centimeter to 5.0 centimeters. More preferably, the weight member 50 has a thickness ranging from 0.5 centimeter to 1.0 centimeters, a height ranging from 1.0 centimeter to 2.0 centimeters and a length ranging from 2.5 centimeter to 4.0 centimeters. The weight member preferably has a mass ranging from 5 grams to 25 grams, more preferably from 7 grams to 20 grams and most preferably 10 grams.

In determining a golfer's ball striking abilities, a method and system such as disclosed in U.S. Pat. No. 6,821,209 for a Method For Predicting A Golfer's Ball Striking Performance, assigned to Callaway Golf Company of Carlsbad, Calif., which is hereby incorporated by reference in its entirety.

The golf club head 20 preferably has a high coefficient of restitution thereby enabling for greater distance of a golf ball hit with the golf club of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf ball from the face of the club head; $v_2$ is the golf ball velocity just after separation of the golf ball from the face of the club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a golf club head 20 having a coefficient of restitution ranging from 0.81 to 0.94, as measured under conventional test conditions, and more preferably from 0.825 to 0.85.

The axes of inertia through the center of gravity of the golf club head are designated X, Y and Z. The X axis extends from the striking plate wall through the center of gravity, CG, and to the rear of the golf club head 20. The Y axis extends from the toe end of the golf club head 20 through the center of gravity, CG, and to the heel end of the golf club head 20. The Z axis extends from the crown section through the center of gravity, CG, and to the sole section.

As defined in *Golf Club Design, Fitting, Alteration & Repair,* 4th Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

The center of gravity and the moment of inertia of a golf club head 20 are preferably measured using a test frame ($X^T$, $Y^T$, $Z^T$), and then transformed to a head frame ($X^H$, $Y^H$, $Z^H$). The center of gravity of a golf club head may be obtained using a center of gravity table having two weight scales thereon, as disclosed in U.S. Pat. No. 6,607,452, entitled High Moment Of Inertia Composite Golf Club, and hereby incorporated by reference in its entirety.

In general, the moment of inertia, Izz, about the Z axis for the golf club head 40 of the present invention will range from 1900 g-cm$^2$ to 3000 g-cm$^2$, preferably from 1990 g-cm$^2$ to 2500 g-cm$^2$, and most preferably from 1990 g-cm$^2$ to 2400 g-cm$^2$. The moment of inertia, Iyy, about the Y axis for the golf club head 42 of the present invention will range from 900 g-cm$^2$ to 1700 g-cm$^2$, preferably from 950 g-cm$^2$ to 1500 g-cm$^2$, and most preferably from 965 g-cm$^2$ to 1200 g-cm$^2$. Table One list the moments of inertia for a 3-wood golf club head 40, a 7-wood golf club head 40, 9-wood golf club head 40 and 11-wood golf club head 40.

The body 25 is alternatively composed of a non-metal material, preferably a composite material such as continuous fiber pre-preg material (including thermosetting materials or thermoplastic materials for the resin). Other materials for the body 25 include other thermosetting materials or other thermoplastic materials such as injectable plastics. Alternatively, the body 25 is composed of low-density metal materials, such as magnesium or aluminum. Exemplary magnesium alloys are available from Phillips Plastics Corporation under the brands AZ-91-D (nominal composition of magnesium with aluminum, zinc and manganese), AM-60-B (nominal composition of magnesium with aluminum and manganese) and AM-50-A (nominal composition of magnesium with aluminum and manganese). The body 25 is preferably manufactured through metal-injection-molding. Alternatively, the body 25 is manufactured through casting, forming, machining, powdered metal forming, electro chemical milling, and the like.

The striking plate wall has varying thickness. In a preferred embodiment, the striking plate wall has a varying thickness such as described in U.S. Pat. No. 6,398,666, for a Golf Club Striking Plate With Variable Thickness, which pertinent parts are hereby incorporated by reference. Other alternative embodiments of the thickness of the striking plate wall are disclosed in U.S. Pat. No. 6,471,603, for a Contoured Golf Club Face and U.S. Pat. No. 6,368,234, for a Golf Club Striking Plate Having Elliptical Regions Of Thickness, which are both owned by Callaway Golf Company and which pertinent parts are hereby incorporated by reference. Alternatively, the striking plate wall has a uniform thickness.

A preferred material is steel 4340, which is heat treated and then coated with a titanium nitride. Titanium materials useful for the striking plate wall include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the striking plate insert 40 include other high strength steel alloy metals and amorphous metals. Such steel materials include 17-4PH, Custom 450, 455, 465 and 465+ stainless steels, AERMET 100 and AERMET 310 alloy steels, all available from Carpenter Specialty Alloys, of Pennsylvania, and C35 maraging steels available from Allvac of North Carolina. Such amorphous metals include beryllium based alloys such as disclosed in U.S. Pat. No. 5,288,344, which pertinent parts are hereby incorporated by reference, quinary metallic glass alloys such as disclosed in U.S. Pat. No. 5,735,975, which pertinent parts are hereby incorporated by reference, and ternary alloys as disclosed in Calculations of Amorphous-Forming Composition Range For Ternary Alloy Systems And Analyses Of Stabilization Of Amorphous Phase And Amorphous-Forming Ability, Takeuchi and Inoue, Materials Transactions, Vol. 42, No. 7, p 1435-1444 (2001), which pertinent parts are hereby incorporated by reference.

In general, the moment of inertia, Izz, about the Z axis for the golf club head 20 of the present invention will range from 3500 g-cm$^2$ to 6000 g-cm$^2$, preferably from 4000 g-cm$^2$ to 5000 g-cm$^2$, and most preferably from 4200 g-cm$^2$ to 4750 g-cm$^2$. The moment of inertia, Iyy, about the Y axis for the golf club head 20 of the present invention will range from 2000 g-cm$^2$ to 4000 g-cm$^2$, preferably from 2500 g-cm$^2$ to 3500 g-cm$^2$, and most preferably from 2900 g-cm$^2$ to 3300 g-cm$^2$. The moment of inertia, Ixx, about the X axis for the golf club head 20 of the present invention will range from 2000 g-cm$^2$ to 4000 g-cm$^2$, preferably from 2500 g-cm$^2$ to 3750 g-cm$^2$, and most preferably from 3000 g-cm$^2$ to 3500 g-cm$^2$.

In general, the golf club head 20 has products of inertia such as disclosed in U.S. Pat. No. 6,425,832, and which is hereby incorporated by reference in its entirety. Preferably, each of the products of inertia, Ixy, Ixz and Iyz, of the golf club head 20 have an absolute value less than 100 grams-centimeter squared. Alternatively, at least two of the products of inertia, Ixy, Ixz or Iyz, of the golf club head 20 have an absolute value less than 100 grams-centimeter squared.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf club head comprising:

a body having a generally C shape when viewed from above with the generally C shape defined by a front elongated section having a heel end arm extending rearward from the front elongated section and a toe end arm extending rearward from the front elongated section, the body having a striking plate wall, a crown section, a sole section and a rear wall; and a plurality of weight members positioned on the rear wall, each of the plurality of weighted members movable along the rear wall, wherein the plurality of weight members is composed of four weight members, with two of the weight members each movably connected along a crown and sole axis, and two of the members each movably connected along a heel to toe axis.

2. The golf club head according to claim 1 wherein the body has a volume ranging from 420 cubic centimeters to 470 cubic centimeters.

3. The golf club head according to claim 1 wherein the body is composed of a material selected from the group consisting of titanium, titanium alloy, steel, magnesium, magnesium alloy, aluminum, aluminum alloy, pre-preg material, thermoplastic polyurethane, and polycarbonate.

4. The golf club head according to claim 1 wherein each of the plurality of weight members ranges in mass from 10 grams to 40 grams.

5. The golf club head according to claim 1 wherein each of the plurality of weight members ranges in mass from 15 grams to 30 grams.

6. The golf club head according to claim 1 wherein the golf club head has mass ranging from 190 grams to 220 grams.

7. The golf club head according to claim 1 wherein the golf club head has a moment of inertia Izz about the center of gravity ranging from 4000 g-cm$^2$ to 5000 g-cm$^2$.

8. The golf club head according to claim 1 wherein the golf club head has a moment of inertia Iyy about the center of gravity ranging from 2000 g-cm$^2$ to 4000 g-cm$^2$.

9. The golf club head according to claim 1 wherein the golf club head has a moment of inertia lxx about the center of gravity ranging from 2000 g-cm$^2$ to 4000 g-cm$^2$.

10. The golf club head according to claim 1 wherein the striking plate wall has variable face thickness.

11. A golf club head comprising:

a body having a front elongated section, a heel end ann and a toe end arm, the front elongated section having a striking plate wall and a rear wall, the heel end arm having a rear wall, an external side wall and an internal side wall, the toe end arm having a rear wall, an external side wall and an internal side wall;

a first plurality of weight members positioned on the rear wall of the front elongated section, each of the plurality of weighted members moveably connected along the rear wall;

at least one second weight member positioned on the rear wall of the heel end arm and moveably connected along a crown to sole axis; and at least one third weight member positioned on the rear wall of the toe end arm and moveably connected along a crown to sole axis.

12. The golf club head according to claim 11 wherein each of the first plurality of weight members, the second weight member and the third weight member ranges in mass from 5 grams to 60 grams.

13. The golf club head according to claim 11 wherein each of the first plurality of weight members, the second weight member and the third weight member ranges in mass from 10 grams to 40 grams.

14. The golf club head according to claim 11 wherein each of the first plurality of weight members, the second weight member and the third weight member ranges in mass from 15 grams to 30 grams.

* * * * *